US012029246B2

(12) United States Patent
Kim et al.

(10) Patent No.: US 12,029,246 B2
(45) Date of Patent: Jul. 9, 2024

(54) CARTRIDGE AND AEROSOL GENERATING DEVICE COMPRISING THE SAME

(71) Applicant: KT&G CORPORATION, Daejeon (KR)

(72) Inventors: Tae Hun Kim, Gyeonggi-do (KR); Jae Sung Choi, Seoul (KR)

(73) Assignee: KT&G CORPORATION, Daejeon (KR)

( * ) Notice: Subject to any disclaimer, the term of this patent is extended or adjusted under 35 U.S.C. 154(b) by 673 days.

(21) Appl. No.: 17/270,785

(22) PCT Filed: Dec. 10, 2020

(86) PCT No.: PCT/KR2020/018037

§ 371 (c)(1),
(2) Date: Feb. 23, 2021

(87) PCT Pub. No.: WO2021/194048

PCT Pub. Date: Sep. 30, 2021

(65) Prior Publication Data

US 2022/0408809 A1 Dec. 29, 2022

(30) Foreign Application Priority Data

Mar. 25, 2020 (KR) ..... 10-2020-0036431

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/20* (2020.01); *A24F 40/30* (2020.01); *A24F 40/48* (2020.01)

(58) Field of Classification Search
CPC ..... A24F 40/10; A24F 40/20; A24F 40/30; A24F 40/42; A24F 40/48
See application file for complete search history.

(56) References Cited

U.S. PATENT DOCUMENTS

| | | | | |
|---|---|---|---|---|
| 9,642,397 | B2 | 5/2017 | Dai et al. | |
| 10,973,087 | B2 | 4/2021 | Wang et al. | |
| 11,131,383 | B2 * | 9/2021 | Liu | A24F 40/485 |
| 11,484,669 | B2 * | 11/2022 | Di Marco | A61M 15/025 |
| 11,571,019 | B2 * | 2/2023 | Murison | B67D 7/0288 |

(Continued)

FOREIGN PATENT DOCUMENTS

| | | | |
|---|---|---|---|
| CN | 105559146 | A | 5/2016 |
| CN | 208550022 | U | 3/2019 |

(Continued)

OTHER PUBLICATIONS

Communication dated Jun. 28, 2022 from the Japanese Patent Office in Application No. 2021-522046.

(Continued)

*Primary Examiner* — Abdullah A Riyami
*Assistant Examiner* — Thang H Nguyen
(74) *Attorney, Agent, or Firm* — Sughrue Mion, PLLC

(57) ABSTRACT

A cartridge includes a storage that stores a liquid composition including an aerosol generating material, and an aerosol generator connected to the storage and including a generation space where an aerosol is generated from the aerosol generating material, wherein the aerosol generator includes a supplier configured to supply the liquid composition from the storage to the generation space, a liquid delivery element disposed in the generation space and configured to absorb the liquid composition supplied from the supplier, a heating element configured to heat the liquid composition absorbed into the liquid delivery element, and a bubble discharger configured to discharge bubbles generated in the generation space such that the bubbles are not discharged through the supplier.

11 Claims, 6 Drawing Sheets

(51) Int. Cl.

| | |
|---|---|
| ***A24F 40/20*** | (2020.01) |
| ***A24F 40/30*** | (2020.01) |
| ***A24F 40/48*** | (2020.01) |

(56) References Cited

U.S. PATENT DOCUMENTS

| | | | | |
|---|---|---|---|---|
| 2015/0272216 | A1* | 10/2015 | Dai | F22B 1/284 131/328 |
| 2018/0332896 | A1* | 11/2018 | Wang | A24F 40/30 |
| 2019/0116880 | A1* | 4/2019 | Lau | A24F 40/50 |
| 2020/0008473 | A1* | 1/2020 | Schmidt | A61M 15/06 |
| 2020/0260788 | A1* | 8/2020 | Cornils | A24F 40/57 |
| 2021/0106051 | A1 | 4/2021 | Han et al. | |
| 2021/0186104 | A1* | 6/2021 | Mironov | A24F 40/44 |
| 2022/0175036 | A1* | 6/2022 | Hazani | A61P 23/02 |

FOREIGN PATENT DOCUMENTS

| | | | | |
|---|---|---|---|---|
| CN | 109619700 | A | 4/2019 | |
| CN | 109770435 | A | 5/2019 | |
| CN | 110089780 | A | 8/2019 | |
| CN | 110475488 | A | 11/2019 | |
| CN | 110477452 | A | 11/2019 | |
| CN | 110897202 | A | 3/2020 | |
| EP | 3603426 | A1 | 2/2020 | |
| KR | 20-0453400 | Y1 | 4/2011 | |
| KR | 10-2019-0138461 | A | 12/2019 | |
| KR | 10-2059415 | B1 | 12/2019 | |
| WO | WO-2018132369 | A1 * | 7/2018 | A61K 45/06 |
| WO | 2019206900 | A1 | 10/2019 | |

OTHER PUBLICATIONS

International Search Report dated Mar. 16, 2021 from the International Searching Authority in International Application No. PCT/KR2020/018037. Extended European Search Report dated Aug. 17, 2021 in Application No. 20859638.7.

Chinese Office Action dated Apr. 20, 2023 in Chinese Application No. 202080005924.4.

* cited by examiner

【Figure 1】
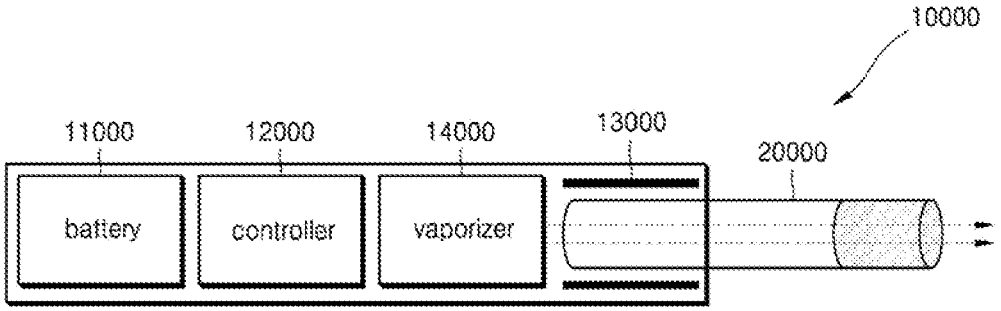
【Figure 2】
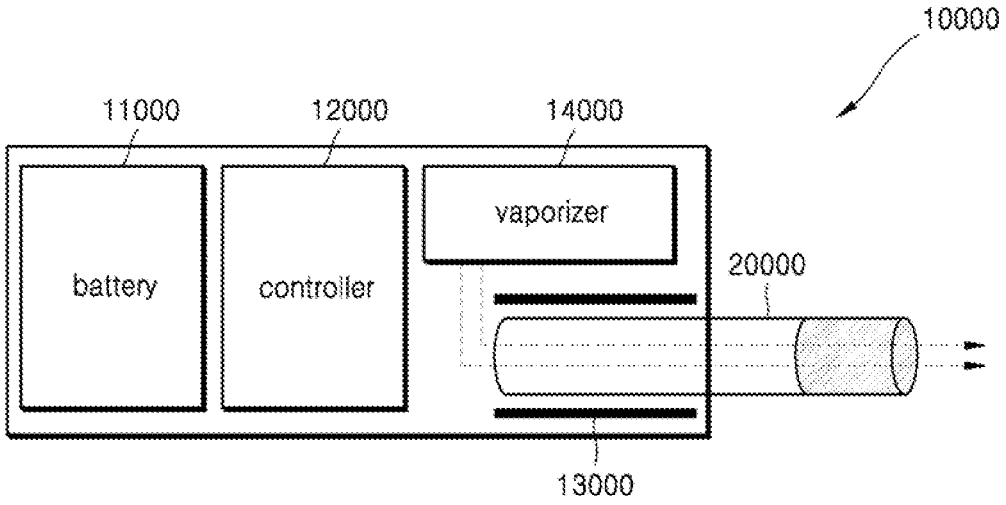

【Figure 3】
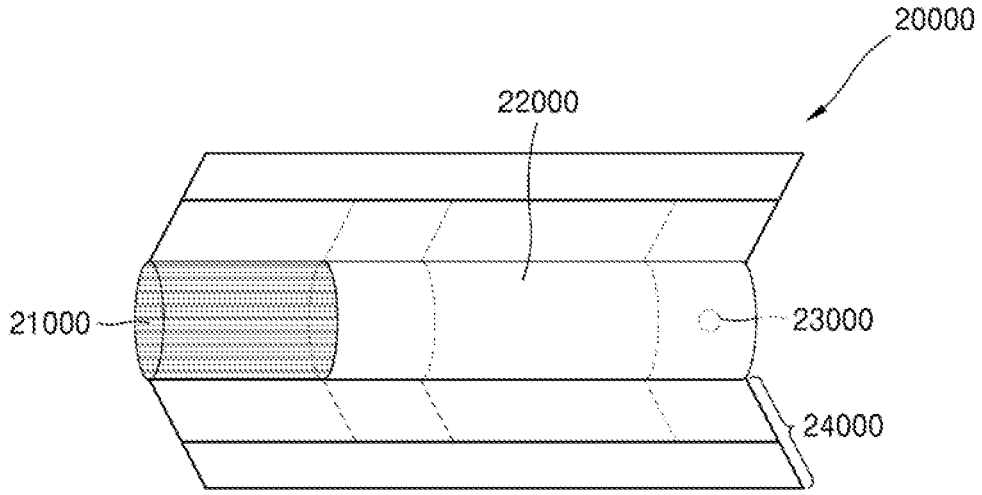

【Figure 4】
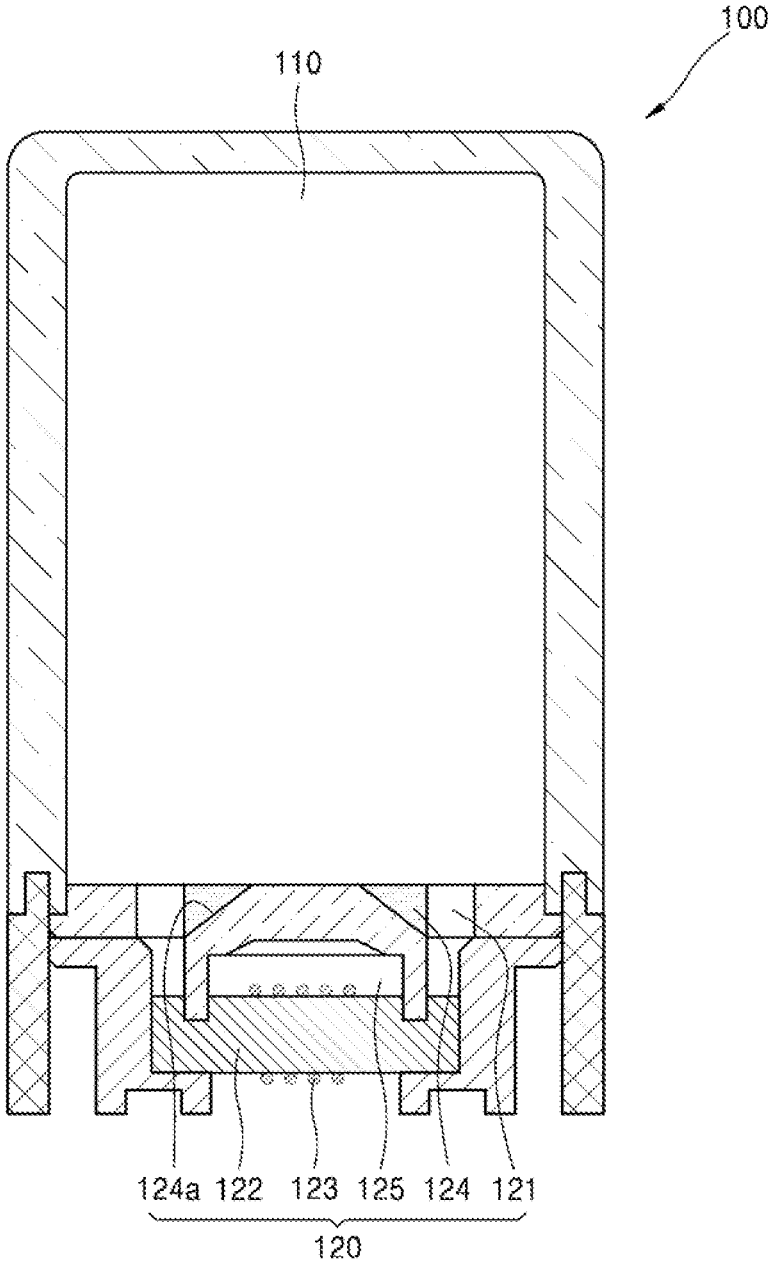

【Figure 5】
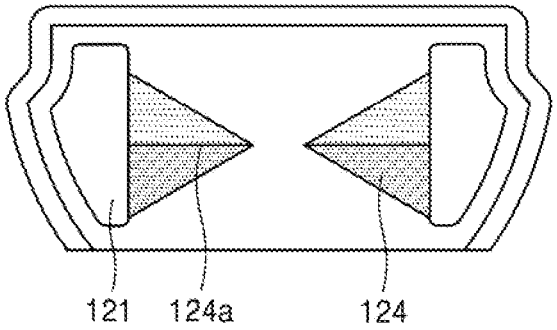
【Figure 6】
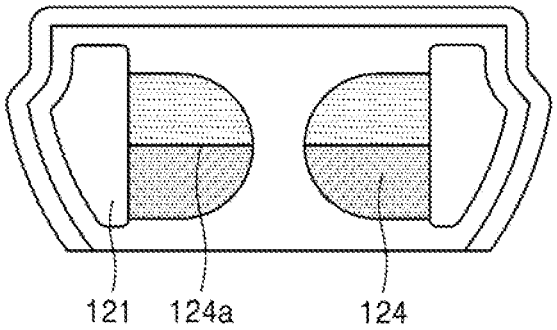
【Figure 7】
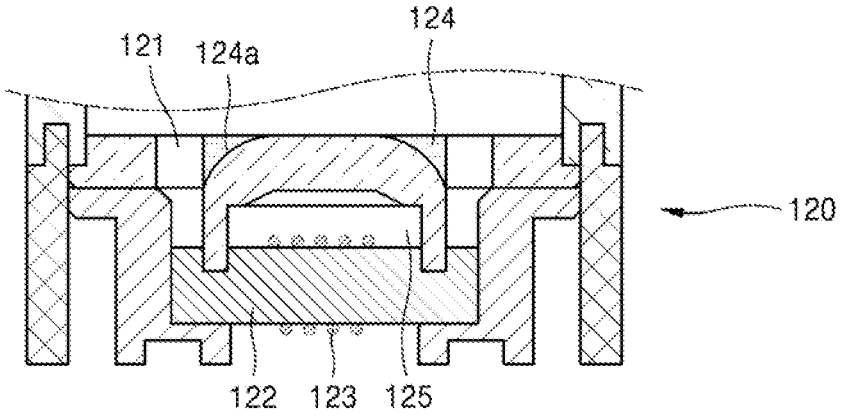

【Figure 8】
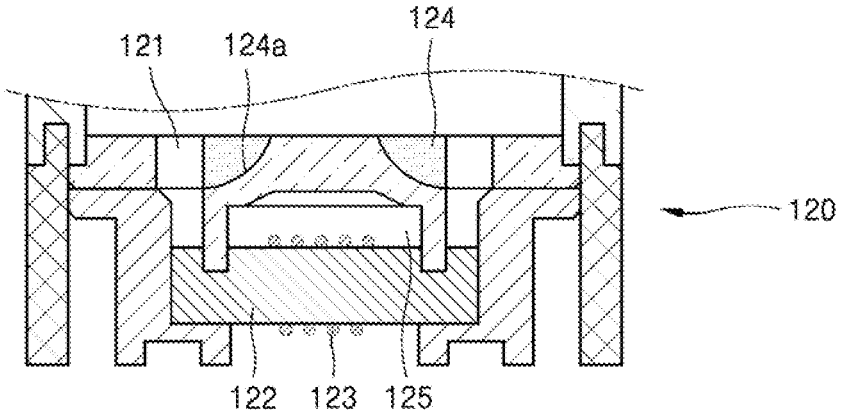
【Figure 9】
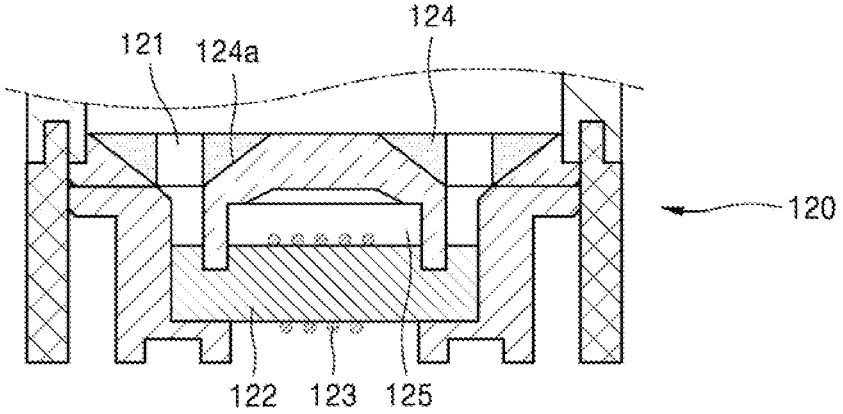

【Figure 10】
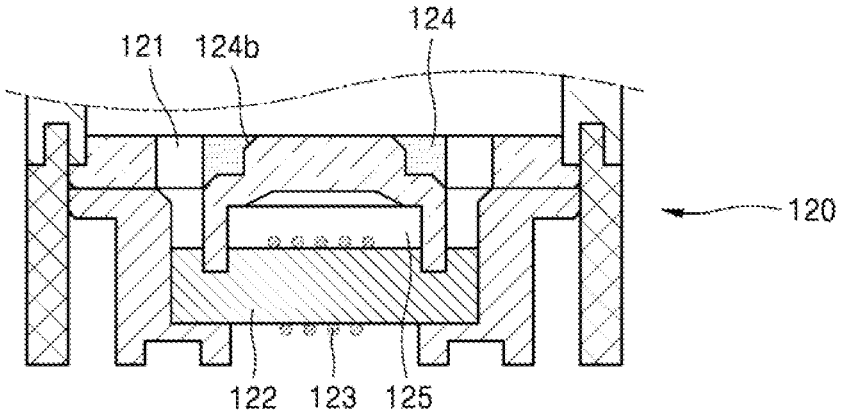

CARTRIDGE AND AEROSOL GENERATING DEVICE COMPRISING THE SAME

TECHNICAL FIELD

One or more embodiments relate to a cartridge and an aerosol generating device including the same, and more particularly, to a cartridge, which discharges bubbles that disturb supply of a liquid composition to a heating element, and an aerosol generating device.

BACKGROUND ART

Recently, the demand for alternative methods to overcome the shortcomings of general cigarettes has increased. For example, there is growing demand for a method of generating aerosol by heating an aerosol generating material in cigarettes, rather than by combusting cigarettes. Accordingly, studies on a heating-type cigarette and a heating-type aerosol generating device have been actively conducted.

Recently, electronic cigarettes, which heat and atomize a liquid composition including an aerosol generating material to allow a user to inhale the atomized vapor, are widely used. An atomizer of an electronic cigarette includes a heating element that atomizes a liquid composition and a liquid supply element that delivers the liquid composition to the heating element. When the liquid composition is not properly supplied to the heating element through the liquid supply element while the atomizer is used, the liquid supply element may be burnt by the heating element. In this case, the user may taste a burnt cigarette which gives an unpleasant feeling. Also, an atomization amount of the atomizer may decrease.

DISCLOSURE

Technical Problem

Technical problems to be solved by the present disclosure are to provide a cartridge and an aerosol generating device including the same. In more detail, one or more embodiments provide a cartridge, which discharges bubbles that disturb supply of a liquid composition to a heating element, and an aerosol generating device.

The technical problems of the present disclosure are not limited to the aforementioned description, and technical problems that are not stated herein may be clearly understood by one of ordinary skill in the art with reference to the attached drawing.

Technical Solution

A cartridge includes a storage in which a liquid composition including an aerosol generating material, and an aerosol generator connected to the storage and including a generation space where an aerosol is generated from the aerosol generating material, wherein the aerosol generator includes a supplier configured to supply the liquid composition from the storage to the generation space, a liquid delivery element disposed in the generation space and configured to absorb the liquid composition supplied from the supplier, a heating element configured to heat the liquid composition absorbed into the liquid delivery element to generate the aerosol, and a bubble discharger configured to discharge bubbles generated in the generation space such that the bubbles are not discharged through the supplier.

Advantageous Effects

The cartridge and the aerosol generating device according to embodiments may discharge bubbles, which block a liquid supply path to the heating element, to the outside of the liquid supply path to prevent a decrease in an atomization amount or flavors, thereby increasing the satisfaction of the user.

Effects according to embodiments are not limited to the above effects, and effects that are not described may be clearly understood by one of ordinary skill in the art from the present specification and the attached drawings.

DESCRIPTION OF DRAWINGS

FIGS. 1 and 2 are diagrams showing examples in which a cigarette is inserted into an aerosol generating device.

FIG. 3 is a drawing illustrating an example of a cigarette.

FIG. 4 is a cross-sectional view of a cartridge according to an embodiment.

FIG. 5 is a top view of an aerosol generator of the cartridge of FIG. 4.

FIG. 6 is a top view of an aerosol generator according to another embodiment.

FIG. 7 is a cross-sectional view of an aerosol generator according to an embodiment.

FIG. 8 is a cross-sectional view of an aerosol generator according to another embodiment.

FIG. 9 is a cross-sectional view of an aerosol generator according to another embodiment.

FIG. 10 is a cross-sectional view of an aerosol generator according to another embodiment.

BEST MODE

According to an aspect of the present disclosure, a cartridge includes a storage that stores a liquid composition including an aerosol generating material, and an aerosol generator connected to the storage and including a generation space where an aerosol is generated from the aerosol generating material, wherein the aerosol generator includes a supplier configured to supply the liquid composition from the storage to the generation space, a liquid delivery element disposed in the generation space and configured to absorb the liquid composition supplied from the supplier, a heating element configured to heat the liquid composition absorbed into the liquid delivery element, and a bubble discharger configured to discharge bubbles generated in the generation space such that the bubbles are not discharged through the supplier.

Also, the supplier may be a hole extending in a direction of gravity such that the liquid composition in the storage may be delivered to the liquid delivery element because of gravity.

Also, the bubble discharger may include a groove that forms an inclined surface forming a certain angle with a direction in which the liquid composition is supplied from the storage to the aerosol generator, and the bubbles may be moved along the inclined surface.

Also, the bubble discharger may be disposed adjacent to the supplier, and a cross-section of the groove taken perpendicular to the direction in which the liquid composition is supplied may be U-shaped.

Also, the bubble discharger may be disposed adjacent to the supplier, and a cross-section of the groove in a direction taken perpendicular to the direction in which the liquid composition is supplied may be V-shaped.

Also, the inclined surface of the groove may be convex towards the storage.

Also, the inclined surface of the groove may be concave towards the storage.

Also, the bubble discharger may include a plurality of groves including the groove, which are disposed along a periphery of the supplier.

Also, the bubble discharger may form at least one step.

Also, an edge of the step of the bubble discharger may be chamfered.

According to another aspect of the present disclosure, an aerosol generating device includes the cartridge, a main body in which a cigarette is inserted, a heater configured to heat the cigarette inserted into the main body, and an air flow passage through which aerosol generated in the cartridge is transmitted to one end of the cigarette.

Mode for Invention

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of" when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

FIGS. 1 and 2 are diagrams showing examples in which a cigarette is inserted into an aerosol generating device.

Referring to FIGS. 1 and 2, an aerosol generating device 10000 includes a battery 11000, a controller 12000, a heater 13000, and a vaporizer 14000. Also, a cigarette 20000 may be inserted into an inner space of the aerosol generating device 10000.

FIGS. 1 and 2 illustrate only components of the aerosol generating device 10000, which are related to the present embodiment. Therefore, it will be understood by one of ordinary skill in the art related to the present embodiment that other components may be further included in the aerosol generating device 10000, in addition to the components illustrated in FIG. 1.

Also, FIGS. 1 and 2 illustrate that the aerosol generating device 10000 includes the heater 13000. However, according to embodiments, the heater 13000 may be omitted.

FIG. 1 illustrates that the battery 11000, the controller 12000, the vaporizer 14000, and the heater 13000 are arranged in series. Also, FIG. 2 illustrates that the vaporizer 14000 and the heater 13000 are arranged in parallel. However, the internal structure of the aerosol generating device 10000 is not limited to the structures illustrated in FIG. 1 or FIG. 2. In other words, according to the design of the aerosol generating device 10000, the battery 11000, the controller 12000, the vaporizer 14000, and the heater 13000 may be differently arranged.

When the cigarette 20000 is inserted into the aerosol generating device 10000, the aerosol generating device 10000 may operate the vaporizer 14000 to generate aerosol from the vaporizer 14000. The aerosol generated by the vaporizer 14000 is delivered to the user by passing through the cigarette 20000. The vaporizer 14000 will be described in more detail later.

The battery 11000 supplies electric power to be used for the aerosol generating device 10000 to operate. For example, the battery 11000 may supply power to heat the heater 13000 or the vaporizer 14000, and may supply power for operating the controller 12000. Also, the battery 11000 may supply power for operations of a display, a sensor, a motor, etc. mounted in the aerosol generating device 10000.

The controller 12000 may generally control operations of the aerosol generating device 10000. In detail, the controller 12000 may control not only operations of the battery 11000, the heater 13000, and the vaporizer 14000, but also operations of other components included in the aerosol generating device 10000. Also, the controller 12000 may check a state of each of the components of the aerosol generating device 10000 to determine whether or not the aerosol generating device 10000 is able to operate.

The controller 12000 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13000 may be heated by the power supplied from the battery 11000. For example, when the cigarette 20000 is inserted into the aerosol generating device 10000, the heater 13000 may be located outside the cigarette 20000. Thus, the heated heater 13000 may increase a temperature of an aerosol generating material in the cigarette 20000.

The heater 13000 may include an electro-resistive heater. For example, the heater 13000 may include an electrically conductive track, and the heater 13000 may be heated when currents flow through the electrically conductive track. However, the heater 13000 is not limited to the example described above and may include all heaters which may be heated to a desired temperature. Here, the desired temperature may be pre-set in the aerosol generating device 10000 or may be set as a temperature desired by a user.

As another example, the heater 13000 may include an induction heater. In detail, the heater 13000 may include an electrically conductive coil for heating a cigarette in an induction heating method, and the cigarette may include a susceptor which may be heated by the induction heater.

FIGS. 1 and 2 illustrate that the heater 13000 is positioned outside the cigarette 20000, but the position of the cigarette 20000 is not limited thereto. For example, the heater 13000 may include a tube-type heating element, a plate-type heating element, a needle-type heating element, or a rod-type heating element, and may heat the inside or the outside of the cigarette 20000, according to the shape of the heating element.

Also, the aerosol generating device 10000 may include a plurality of heaters 13000. Here, the plurality of heaters 13000 may be inserted into the cigarette 20000 or may be arranged outside the cigarette 20000. Also, some of the plurality of heaters 13000 may be inserted into the cigarette 20000 and the others may be arranged outside the cigarette 20000. In addition, the shape of the heater 13000 is not limited to the shapes illustrated in FIGS. 1 and 2 and may include various shapes.

The vaporizer 14000 may generate an aerosol by heating a liquid composition and the generated aerosol may pass through the cigarette 20000 to be delivered to a user. In other words, the aerosol generated via the vaporizer 14000 may move along an air flow passage of the aerosol generating device 10000 and the air flow passage may be configured such that the aerosol generated via the vaporizer 14000 passes through the cigarette 20000 to be delivered to the user.

For example, the vaporizer 14000 may include a liquid storage, a liquid delivery element, and a heating element, but it is not limited thereto. For example, the liquid storage, the liquid delivery element, and the heating element may be included in the aerosol generating device 10000 as independent modules.

The liquid storage may store a liquid composition. For example, the liquid composition may be a liquid including a tobacco-containing material or a volatile tobacco flavor component, or a liquid including a non-tobacco material. The liquid storage may be formed to be attached to and detached from the vaporizer 14000, or may be formed integrally with the vaporizer 14000.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, an aerosol may be generated.

For example, the vaporizer 14000 may be referred to as a cartomizer or an atomizer, but it is not limited thereto.

The aerosol generating device 10000 may further include other components in addition to the battery 11000, the controller 12000, and the heater 13000. For example, the aerosol generating device 10000 may include a display capable of outputting visual information and/or a motor for outputting haptic information. Also, the aerosol generating device 10000 may include at least one sensor (e.g., a puff detecting sensor, a temperature detecting sensor, a cigarette insertion detecting sensor, etc.). Also, the aerosol generating device 10000 may be formed as a structure where, even when the cigarette 20000 is inserted into the aerosol generating device 10000, external air may be introduced or internal air may be discharged.

Although not illustrated in FIGS. 1 and 2, the aerosol generating device 10000 and an additional cradle may form together a system. For example, the cradle may be used to charge the battery 11000 of the aerosol generating device 10000. Alternatively, the heater 13000 may be heated when the cradle and the aerosol generating device 10000 are coupled to each other.

The cigarette 20000 may be similar as a general combustive cigarette. For example, the cigarette 20000 may be divided into a first portion including an aerosol generating material and a second portion including a filter, etc. Alternatively, the second portion of the cigarette 20000 may also include an aerosol generating material. For example, an aerosol generating material made in the form of granules or capsules may be inserted into the second portion.

The entire first portion may be inserted into the aerosol generating device 10000, and the second portion may be exposed to the outside. Alternatively, only a portion of the first portion may be inserted into the aerosol generating device 10000, or a portion of the first portion and a portion of the second portion may be inserted thereinto. The user may puff an aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 10000. For example, the opening and closing and/or a size of the air passage formed in the aerosol generating device 10000 may be adjusted by the user. Accordingly, the amount of smoke and a smoking impression may be adjusted by the user. As another example, the external air may flow into the cigarette 20000 through at least one hole formed in a surface of the cigarette 20000.

Hereinafter, an example of the cigarette 20000 will be described with reference to FIG. 3.

FIG. 3 is a drawing illustrating an example of a cigarette.

Referring to FIG. 3, the cigarette 20000 may include a tobacco rod 21000 and a filter rod 22000. The first portion described above with reference to FIGS. 1 and 2 may include the tobacco rod 21000, and the second portion may include the filter rod 22000.

FIG. 3 illustrates that the filter rod 22000 includes a single segment. However, the filter rod 22000 is not limited thereto. In other words, the filter rod 22000 may include a plurality of segments. For example, the filter rod 22000 may include a first segment configured to cool an aerosol and a second segment configured to filter a certain component included in the aerosol. Also, according to embodiments, the filter rod 22000 may further include at least one segment configured to perform other functions.

The cigarette 2000 may be packaged by at least one wrapper 24000. The wrapper 24000 may have at least one hole through which external air may be introduced or internal air may be discharged. For example, the cigarette 20000 may be packaged by one wrapper 24000. As another example, the cigarette 20000 may be double-packaged by at least two wrappers 24000. For example, the tobacco rod 21000 may be packaged by a first wrapper, and the filter rod 22000 may be packaged by a second wrapper. Also, the tobacco rod 21000 and the filter rod 22000, which are respectively packaged by separate wrappers, may be coupled to each other, and the entire cigarette 20000 may be packaged by a third wrapper. When each of the tobacco rod 21000 and the filter rod 22000 includes a plurality of segments, each segment may be packaged by a separate wrapper, and the entire cigarette 20000 including the plurality of segments may be re-packaged by another wrapper.

The tobacco rod 21000 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21000 may include other additives, such as flavors, a wetting agent, and/or organic acid. Also, the tobacco rod 21000 may include a flavored liquid, such as menthol or a moisturizer, which is injected to the tobacco rod 21000.

The tobacco rod 21000 may be manufactured in various forms. For example, the tobacco rod 21000 may be formed as a sheet or a strand. Also, the tobacco rod 21000 may be formed as cut tobacco, which is formed of tiny bits cut from a tobacco sheet. Also, the tobacco rod 21000 may be surrounded by a heat conductive material. For example, the heat-conducting material may be, but is not limited to, a metal foil such as aluminum foil. For example, the heat conductive material surrounding the tobacco rod 21000 may uniformly distribute heat transmitted to the tobacco rod 21000, and thus, the heat conductivity applied to the tobacco rod may be increased and taste of the tobacco may be improved. Also, the heat conductive material surrounding the tobacco rod 21000 may function as a susceptor heated by the induction heater. Here, although not illustrated in the drawings, the tobacco rod 21000 may further include an additional susceptor, in addition to the heat conductive material surrounding the tobacco rod 21000.

The filter rod 22000 may include a cellulose acetate filter. Shapes of the filter rod 22000 are not limited. For example, the filter rod 22000 may include a cylinder-type rod or a tube-type rod having a hollow inside. Also, the filter rod 22000 may include a recess-type rod. When the filter rod 22000 includes a plurality of segments, at least one of the plurality of segments may have a different shape.

The filter rod 22000 may be formed to generate flavors. For example, a flavoring liquid may be injected onto the filter rod 22000, or an additional fiber coated with a flavoring liquid may be inserted into the filter rod 22000.

Also, the filter rod 22000 may include at least one capsule 23000. Here, the capsule 23000 may generate a flavor or an aerosol. For example, the capsule 23000 may have a configuration in which a liquid containing a flavoring material is wrapped with a film. For example, the capsule 23000 may have a spherical or cylindrical shape, but is not limited thereto.

When the filter rod 22000 includes a segment configured to cool the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and is not limited as long as the cooling segment cools the aerosol.

Although not illustrated in FIG. 3, the cigarette 20000 according to an embodiment may further include a front-end filter. The front end plug may be located on one side of the tobacco rod 21000 which is opposite to the filter rod 22000. The front-end filter may prevent the tobacco rod 21000 from being detached outwards and prevent a liquefied aerosol from flowing into the aerosol generating device 10000 (see FIGS. 1 and 2) from the tobacco rod 21000, during smoking.

FIG. 4 is a cross-sectional view of a cartridge 100 according to an embodiment. The cartridge 100 may be the vaporizer 14000, and the descriptions that are already provided will not be repeated.

Referring to FIG. 4, the cartridge 100 may include a storage 110 in which a liquid composition including an aerosol generating material is stored.

The storage 110 may store therein the liquid composition such that the liquid composition is supplied to the cartridge 100. Also, the storage 110 may be integrally formed with the cartridge 100 and may be detachably attached to the cartridge 100.

The cartridge 100 may include an aerosol generator 120 that is connected to the storage 110 and forms a generation space 125 where an aerosol is generated from the aerosol generating material.

The aerosol generator 120 may include a supplier 121 that supplies the liquid composition to the generation space 125 from the storage 110. The supplier 121 may have a delivery path for the liquid composition which extends in a direction of gravity, and thus, the liquid composition in the storage 110 may be moved to the generation space 125 due to the gravity. However, one or more embodiments are not limited thereto.

The supplier 121 may be implemented by a hole. For example, a cross-section of the hole may be a circle, but embodiments are not limited thereto. For smooth supply of the liquid composition, the shape of the supplier 121 may vary according to a structure, a shape, and the like of the cartridge 100.

A liquid delivery element 122 may be disposed inside the generation space 125 and may absorb the liquid composition supplied from the supplier 121. Also, the liquid delivery element 122 may deliver the liquid composition in the storage 110 to a heating element 123.

The heating element 123 may heat the liquid composition absorbed into the liquid delivery element 122 such that an aerosol may be generated.

In the generation space 125, the liquid delivery element 122 and the heating element 123 may be disposed. During the atomization of the cartridge 100, the liquid composition, which is moved from the storage 110 to the supplier 121, may be atomized inside the generation space 125, and thus, the aerosol may be generated. Also, in the generation space 125, a liquid composition, which is not absorbed into the liquid delivery element 122, may exist in addition to the liquid composition absorbed into the liquid delivery element 122. Accordingly, the heating element 123 may be soaked in the liquid composition that is not absorbed into the liquid delivery element 122.

The liquid composition is atomized when the heating element 123 is heated, and in some cases, bubbles may be formed in the generation space 125 in the process of vaporization. This may also happen when the aerosol, which is atomized by the heating element 123, is not completely inhaled by the user. This also happens when atomization quantity is excessively large because of high power of the heating element 123, when the user tilts the cartridge during atomization, and etc.

The bubbles generated in the generation space 125 may be moved to the supplier 121. The bubbles moved to the supplier 121 may disturb an inflow of the liquid composition from the storage 110 to the generation space 125. When the bubbles disturb the inflow of the liquid composition, the liquid composition may not be appropriately delivered to the liquid delivery element 122 in the generation space 125. Thus, the liquid delivery element 122 may be burnt by the heating element 123 during the atomization, which causes the inconvenience of the user. Also, because the amount of the liquid composition to be atomized by the heating element 123 temporarily decreases, the atomization amount may be small compared to the atomization amount when no bubbles are generated during the atomization.

In this regard, the cartridge 100 according to an embodiment may include a bubble discharger 124. The bubble discharger 124 may discharge the bubbles generated in the generation space 125 such that the bubbles are not discharged through the supplier 121. For example, the bubble discharger 124 may discharge the bubbles to the storage 110, but embodiments are not limited thereto.

FIG. 5 is a top view of the aerosol generator 120 of the cartridge 100 of FIG. 4.

Referring to FIG. 5, the bubble discharger 124 may be a groove that forms an inclined surface 124*a* forming a certain angle with a direction in which the liquid composition is supplied. The groove corresponding to the bubble discharger 124 may be dented towards the aerosol generator 120, but one or more embodiments are not limited thereto. The bubbles generated in the generation space 125 may move along the inclined surface 124*a* of the groove, instead of moving up straight through the supplier 121. Therefore, in a sense, the bubble discharger 124 may be seen as a portion of a hole that provides fluid communication between the storage 110 and the generation space 125, while the remaining portion of the hole serves as the supplier 121.

The bubble discharger 124 may be disposed adjacent to the supplier 121, and a cross-section of the groove taken perpendicular to the direction in which the liquid composition is supplied from the storage 110 through the supplier 121 may be V-shaped. Because the shape of the cross-section is V, the bubbles may be rapidly discharged to the outside of the supplier 121 along the inclined surface 124*a* and another surface of the groove.

FIG. 6 is a top view of another example of the aerosol generator 120 of the cartridge of FIG. 5.

Referring to FIG. 6, the bubble discharger 124 may be disposed adjacent to the supplier 121, and a cross-section of the groove taken perpendicular to the direction in which the liquid composition is supplied through the supplier 121 may have a U shape. Because of the U shape of the cross-section providing a large space for the bubbles, may increase, and thus, bubbles having relatively great sizes may be discharged to the outside of the supplier 121.

The cross-section of the groove of the bubble discharger 124 is not limited thereto, and the shape of the cross-section may vary according to a structure, a shape, and the like of the cartridge 100.

FIG. 7 is a cross-sectional view of another example of the cartridge 100 of FIG. 4. Referring to FIG. 7, the inclined surface 124*a* may extend in a curved line. Therefore, the inclined surface 124*a* of the groove of the bubble discharger 124 may be convex towards the storage 110. For example, the inclined surface 124*a* of the groove may be convex towards the storage 110 in a shape of a cycloid curve. Therefore, the bubbles may be moved along the inclined surface 124*a* and may maintain the smooth supply of the liquid composition of the supplier 121.

FIG. 8 is a cross-sectional view of another example of the cartridge 100 of FIG. 4.

Referring to FIG. 8, the inclined surface 124*a* of the groove of the bubble discharger 124 may be concave towards the storage. Because the inclined surface 124*a* of the groove is concave towards the storage, the bubble discharger 124 may discharge big bubbles, which disturb the supply of the liquid composition of the supplier 121, to the outside of the supplier 121.

The shape of the inclined surface 124*a* of the groove of the bubble discharger 124 is not limited thereto and may differ according to the structure, the shape, and the like of the cartridge 100.

FIG. 9 is a cross-sectional view of another example of the cartridge 100 of FIG. 4.

Referring to FIG. 9, the bubble discharger 124 may be formed as one or more grooves disposed along a periphery of the supplier 121. For example, two grooves of the bubble discharger 124 may be disposed opposite each other with the supplier 121 disposed in between. As the grooves of the bubble discharger 124 faces each other, the bubbles, which are generated in the generation space 125 may be effectively discharged without being concentrated in the supplier 121. Also, the bubble discharger 124 may be continuously formed along the periphery of the supplier 121.

FIG. 10 is a cross-sectional view of another example of the cartridge 100 of FIG. 4.

Referring to FIG. 10, the bubble discharger 124 may have a step. Accordingly, the bubbles are moved to the bubble discharger 124 while a liquid inflow passage is secured. Thus, the bubbles are discharged while the liquid composition smoothly flows into the generation space 125.

An edge of the step difference of the bubble discharger 124 may be chamfered. The bubbles generated in the generation space 125 may be moved to the bubble discharger 124 along a chamfered surface 124*b* of the edge of the step. Accordingly, the bubbles are quickly moved to the bubble discharger 124, and thus, the liquid inflow passage of the supplier 121 may be secured.

An aerosol generating device according to another embodiment may include any one of the above-described cartridges 100 and may include a main body, into which a cigarette may be inserted, a heater that heats the cigarette inserted into the main body, and an air flow passage through which aerosol generated in the cartridge 100 is transmitted to one end of the cigarette. In this case, when the user smokes, the user may simultaneously inhale the aerosol generated in the cartridge 100 and the aerosol generated in the cigarette heated by a heater.

As described, the cartridge 100 may be used in an aerosol generating device that generates aerosol by heating a liquid composition, and may also be used in an aerosol generating device that generates aerosol by heating a cigarette.

At least one of the components, elements, modules or units (collectively "components" in this paragraph) represented by a block in the drawings, such as the controller 12000, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. A cartridge comprising:

a storage configured to store a liquid composition comprising an aerosol generating material; and an aerosol generator connected to the storage and including a generation space where an aerosol is generated from the aerosol generating material, wherein the aerosol generator comprises:

a supplier configured to supply the liquid composition from the storage to the generation space;

a liquid delivery element disposed in the generation space and configured to absorb the liquid composition supplied from the supplier;

a heating element configured to heat the liquid composition absorbed into the liquid delivery element; and a bubble discharger configured to discharge bubbles generated in the generation space such that the bubbles are not discharged through the supplier, wherein the bubble discharger comprises a groove that forms an inclined surface forming a certain angle in a direction in which the liquid composition is supplied from the storage to the aerosol generator.

2. The cartridge of claim 1, wherein the supplier is a hole extending in a direction of gravity such that the liquid composition in the storage is delivered to the liquid delivery element by gravity.

3. The cartridge of claim 1, the bubbles are moved along the inclined surface.

4. The cartridge of claim 3, wherein the bubble discharger is disposed adjacent to the supplier, and a cross-section of the groove taken perpendicular to the direction in which the liquid composition is supplied is U-shaped.

5. The cartridge of claim 3, wherein the bubble discharger is disposed adjacent to the supplier, and a cross-section of the groove taken perpendicular to the direction in which the liquid composition is supplied is V-shaped.

6. The cartridge of claim 3, wherein the inclined surface of the groove is convex towards the storage.

7. The cartridge of claim 3, wherein the inclined surface of the groove is concave towards the storage.

8. The cartridge of claim 3, wherein the bubble discharger comprises a plurality of grooves including the groove, which are disposed along a periphery of the supplier. step.

9. The cartridge of claim 1, wherein the bubble discharger forms at least one step.

10. The cartridge of claim 9, wherein an edge of the at least one step is chamfered.

11. An aerosol generating device comprising:

the cartridge of claim 1;

a main body configured to receive a cigarette;

a heater configured to heat the cigarette inserted into the main body; and an air flow passage configured to transmit the aerosol generated in the cartridge to one end of the cigarette.

* * * * *